US008782837B2

(12) United States Patent
Lee et al.

(10) Patent No.: US 8,782,837 B2
(45) Date of Patent: Jul. 22, 2014

(54) WASHING MACHINE AND CONTROL METHOD OF THE SAME

(75) Inventors: Sung Mo Lee, Gunpo-si (KR); Jae Young Choi, Seongnam-si (KR); Jung Won Choi, Goyang-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 887 days.

(21) Appl. No.: 12/805,119

(22) Filed: Jul. 13, 2010

(65) Prior Publication Data

US 2011/0023239 A1 Feb. 3, 2011

(30) Foreign Application Priority Data

Jul. 31, 2009 (KR) ..... 10-2009-0070651

(51) Int. Cl.
*D06F 37/24* (2006.01)
*D06F 37/30* (2006.01)

(52) U.S. Cl.
USPC ..... 8/159; 68/12.02; 68/133; 68/140

(58) Field of Classification Search
USPC ..... 68/12.02, 23 R, 12.24, 23.6, 23.7, 133, 68/140; 8/137, 158–159; 192/17 C, 17 D, 192/18 R, 18 B, 12 D, 69.8, 71, 79, 84.6
See application file for complete search history.

(56) References Cited

U.S. PATENT DOCUMENTS 5,396,413 A * 3/1995 Kaneko et al. ..... 700/1
5,586,455 A * 12/1996 Imai et al. ..... 68/12.02
6,049,930 A * 4/2000 Hisano et al. ..... 8/159
6,176,108 B1 * 1/2001 Bae et al. ..... 68/23.7
6,189,171 B1 * 2/2001 Savkar et al. ..... 8/159
6,257,027 B1 * 7/2001 Imai ..... 68/12.12
6,823,754 B2 * 11/2004 Boll et al. ..... 73/865.9
7,171,715 B2 * 2/2007 Yoon et al. ..... 8/159
7,409,737 B2 * 8/2008 Cho et al. ..... 8/159
7,418,841 B2 * 9/2008 Yoon et al. ..... 68/12.24
7,543,464 B2 * 6/2009 Choi et al. ..... 68/12.24
2007/0028399 A1 2/2007 Yoon et al.

FOREIGN PATENT DOCUMENTS

CN 1224784 8/1999
CN 1547632 11/2004
CN 1692196 11/2005

OTHER PUBLICATIONS

Chinese Office Action mailed Nov. 4, 2013 in related Chinese Application No. 201010242970.4.

* cited by examiner

*Primary Examiner* — Joseph L Perrin
*Assistant Examiner* — Kevin G Lee
(74) *Attorney, Agent, or Firm* — Staas & Halsey LLP

(57) ABSTRACT

Disclosed herein are a washing machine and a control method of the same. The control method includes detecting a position of a coupler coupled to a rotor of a drive motor in a first mode in which power from the drive motor is transmitted to a washing shaft and a spin-drying shaft and coupled to a rotation prevention unit of a water tub in a second mode in which the power from the drive motor is transmitted to the washing shaft, determining based on the position of the coupler whether the coupling of the coupler is abnormal, shaking the coupler at a present position or moving the coupler to a position before mode switching and shaking the coupler such that the coupler is moved to a position where the mode switching is to be performed.

8 Claims, 11 Drawing Sheets

FIG. 10

| NUMBER OF ERROR TIMES | 1 | 2 | 3 | ··· | N |
|---|---|---|---|---|---|
| TEMPORARY WASHING MODE | $V_{w1}$ | $V_{w2}$ | $V_{w3}$ | ··· | $V_{wN}$ |
| TEMPORARY SPIN-DRYING MODE | $V_{d1}$ | $V_{d2}$ | $V_{d3}$ | ··· | $V_{dN}$ |

WASHING MACHINE AND CONTROL METHOD OF THE SAME

CROSS-REFERENCE TO RELATED APPLICATIONS

This application claims the benefit of Korean Patent Application No. 2009-0070651, filed on Jul. 31, 2009 in the Korean Intellectual Property Office, the disclosure of which is incorporated herein by reference.

BACKGROUND

1. Field

Embodiments relate to a washing machine and a control method of the same that reduces damage to teeth of components caused when power from a drive motor to rotate a pulsator is selectively transmitted to a washing shaft or a spin-drying shaft and the washing shaft during switching between a washing mode and a spin-drying mode.

2. Description of the Related Art

In a washing machine, a coupler is tooth-engaged with a water tub or a rotor of a drive motor to rotate a pulsator to selectively transmit rotation force from the drive motor to a washing shaft or a spin-drying shaft such that the pulsator alone is rotated to perform a washing cycle in a washing mode, and the pulsator and a spin-drying tub are simultaneously rotated to perform a spin-drying cycle.

However, when the pulsator or the spin-drying tub is rotated in a state in which the coupler is not normally tooth-engaged with the water tub or the rotor, collision between teeth occurs, with the result that the teeth are damaged, and, in addition, frictional noise is generated.

SUMMARY

Therefore, it is an aspect to provide a washing machine and a control method of the same that adjusts the position of a coupler, when coupling between the coupler and a rotation prevention unit of a water tub or between the coupler and a rotor of the drive motor is abnormal, such that the coupling is normally achieved, thereby preventing damage to components and lowering of washing performance.

Additional aspects will be set forth in part in the description which follows and, in part, will be apparent from the description, or may be learned by practice of the embodiments.

In accordance with one aspect provided is a control method of a washing machine, having a coupler coupled to a rotor of a drive motor or a rotation prevention unit of a water tub to selectively transmit power from the drive motor to a washing shaft or a spin-drying shaft, to perform a first mode in which the coupler is moved to transmit the power to the washing shaft and the spin-drying shaft and a second mode in which the coupler is moved to transmit the power to the washing shaft but not the spin-drying shaft, includes detecting a position of the coupler when mode switching is performed, determining based on the position of the coupler whether coupling of the coupler is abnormal, and rotating the drive motor such that the coupler is shaken when it is determined that the coupling of the coupler is abnormal.

In accordance with another aspect provided is a control method of a washing machine, having a coupler coupled to a rotor of a drive motor or a rotation prevention unit of a water tub to selectively transmit power from the drive motor to a washing shaft or a spin-drying shaft, to perform a first mode in which the coupler is moved to transmit the power to the washing shaft and the spin-drying shaft and a second mode in which the coupler is moved to transmit the power to the washing shaft but not the spin-drying shaft, includes detecting a position of the coupler when mode switching is performed, determining, based on the position of the coupler, whether coupling of the coupler is abnormal, moving the coupler to a position before mode switching when it is determined that the coupling of the coupler is abnormal, rotating the drive motor such that the coupler is shaken, and moving the coupler to a position where the mode switching is to be performed.

In accordance with another aspect provided is a control method of a washing machine having a coupler coupled to a rotor of a drive motor in a first mode in which power from the drive motor is transmitted to a washing shaft and a spin-drying shaft and coupled to a rotation prevention unit of a water tub in a second mode in which the power from the drive motor is transmitted to the washing shaft but not the spin-drying shaft, includes detecting a position of the coupler when mode switching is performed, determining, based on the position of the coupler, whether coupling of the coupler is abnormal, moving the coupler to a position before mode switching and shaking the pulsator or the water tub when it is determined that the coupling of the coupler is abnormal, and moving the coupler to a position where the mode switching is to be performed.

In accordance with a further aspect provided is a washing machine, comprising a drive motor comprising a rotor, a washing shaft, a spin drying shaft, a water tub comprising a rotation prevention unit, a coupler coupled to the rotor in a first mode in which power from the drive motor is transmitted to a washing shaft and a spin-drying shaft and coupled to the rotation prevention unit in a second mode in which the power from the drive motor is transmitted to the washing shaft but not the spin-drying shaft, includes an actuator to move the coupler, a detection unit to detect a position of the coupler moved by the actuator, and a controller to determine based on the detected position of the coupler whether the coupling of the coupler is abnormal, move the coupler to a position before mode switching when it is determined that the coupling of the coupler is abnormal, rotate the drive motor such that the coupler is shaken, and move the coupler to a position where the mode switching is to be performed.

BRIEF DESCRIPTION OF THE DRAWINGS

These and/or other aspects will become apparent and more readily appreciated from the following description of the embodiments, taken in conjunction with the accompanying drawings of which:

FIG. 10 is a table showing the change in drive voltage of a drive motor based on the number of coupler coupling error times for each mode in a washing machine according to present embodiments.

DETAILED DESCRIPTION

Figure 1:
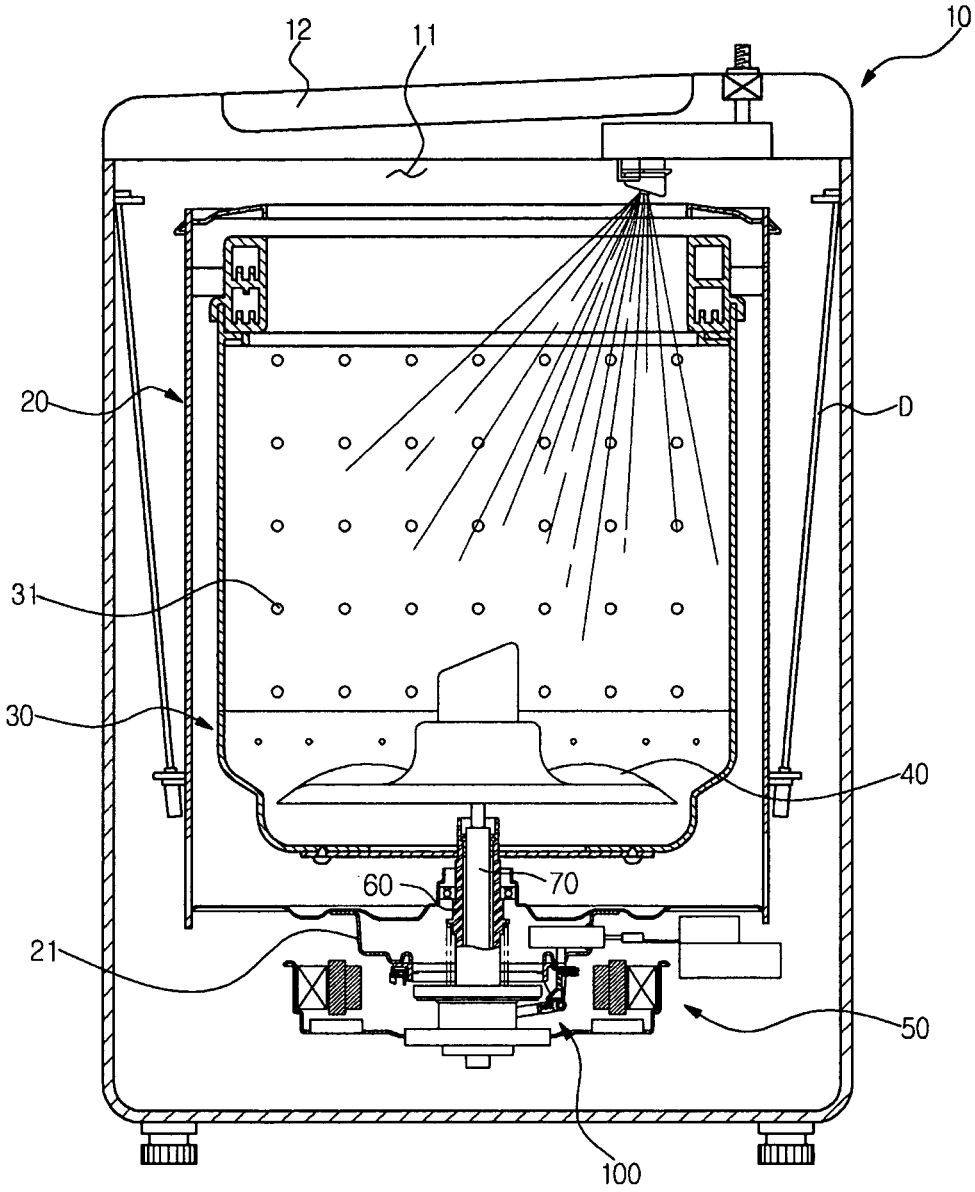
FIG. 1 is a schematic view illustrating a washing machine according to an embodiment.

Reference will now be made in detail to the embodiments, examples of which are illustrated in the accompanying drawings, wherein like reference numerals refer to the like elements throughout. The embodiments are described below by referring to the figures.

FIG. 1 is a schematic view illustrating a washing machine according to an embodiment.

As shown in FIG. 1, the washing machine includes a machine body 10 forming the external appearance of the washing machine, a water tub 20 mounted in the machine body 10 to receive wash water, and a spin-drying tub 30 rotatably provided in the water tub 20, a pulsator 40 rotatably provided at the bottom of the spin-drying tub 30, and a drive unit 50 to drive the spin-drying tub 30 or the pulsator 40.

The machine body 10 includes a laundry inlet port 11 formed at the top of the machine body 10 to allow the introduction of laundry therethrough and a cover 12 hingedly mounted at the machine body 10 to open and close the laundry inlet port 11.

The water tub 20 is configured in the shape of a cylinder open at the top thereof. The water tub 20 is supported at the machine body 10 in a suspended manner by several suspension devices D coupled to a lower circumference of the water tub 20. The suspension devices D attenuate vibration generated from the machine body 10 or the water tub 20 during washing or spin-drying.

The spin-drying tub 30 is configured in the shape of a cylinder open at the top thereof. The spin-drying tub 30 is provided at the circumference thereof with a plurality of spin-drying holes 31 through which the spin-drying tub 30 communicates with the water tub 20.

The pulsator 40 is rotated in alternating directions to generate a stream of water, by which laundry in the spin-drying tub 30 is agitated together with wash water.

The drive unit 50 includes a drive motor 51 to generate drive force when power is supplied to the drive motor 51 and a power switching device 100 to transmit the drive force from the drive motor 51 to the pulsator 40 alone or to both the pulsator 40 and the spin-drying tub 30. Reference numeral 60 indicates a hollow spin-drying shaft 60 coupled to the spin-drying tub 30, and reference numeral 70 indicates a washing shaft 70 mounted in the hollow part of the spin-drying shaft 60 such that the washing shaft 70 is connected to the pulsator 40 through the water tub 20 and the spin-drying shaft 60.

Hereinafter, the drive unit 50 of this embodiment will be described with reference to the following drawings.

Figure 2:
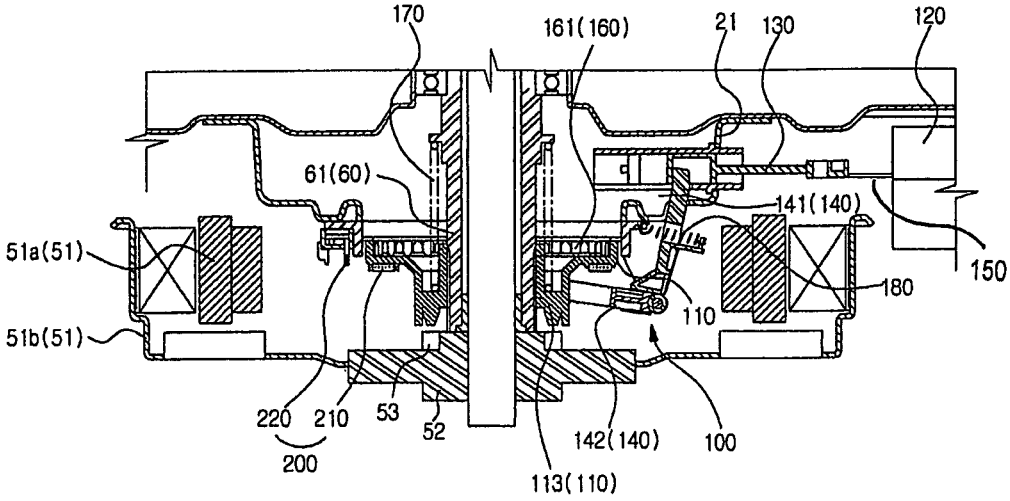
FIG. 2 is a vertical sectional view of a portion of the washing machine of FIG. 1 illustrating the operation of a power switching device in a washing mode.
Figure 3:
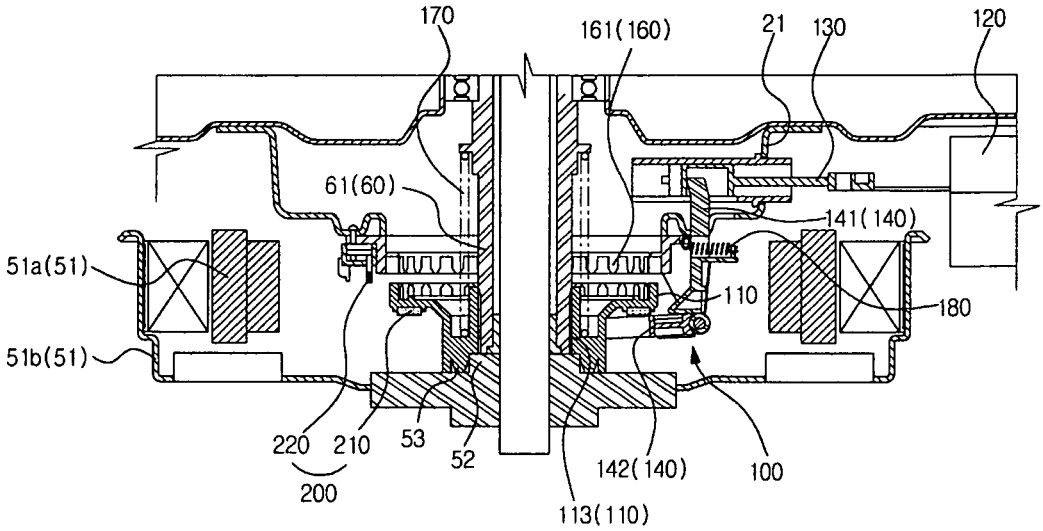
FIG. 3 is a vertical sectional view of the principal part of the washing machine of FIG. 1 illustrating the operation of the power switching device in a spin-drying mode.
Figure 4:
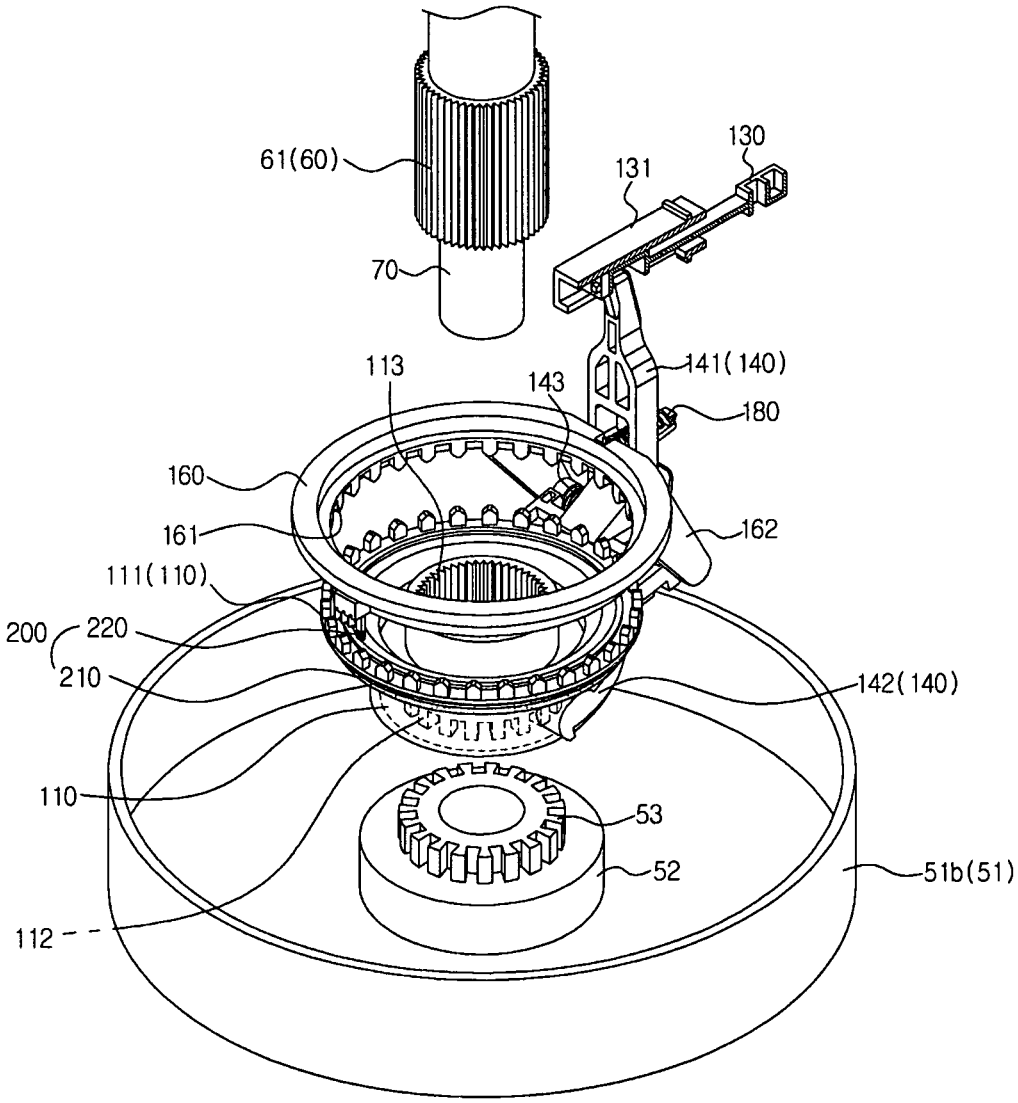
FIG. 4 is a perspective view illustrating the structure of the power switching device of the washing machine of FIG. 1.
Figure 5:
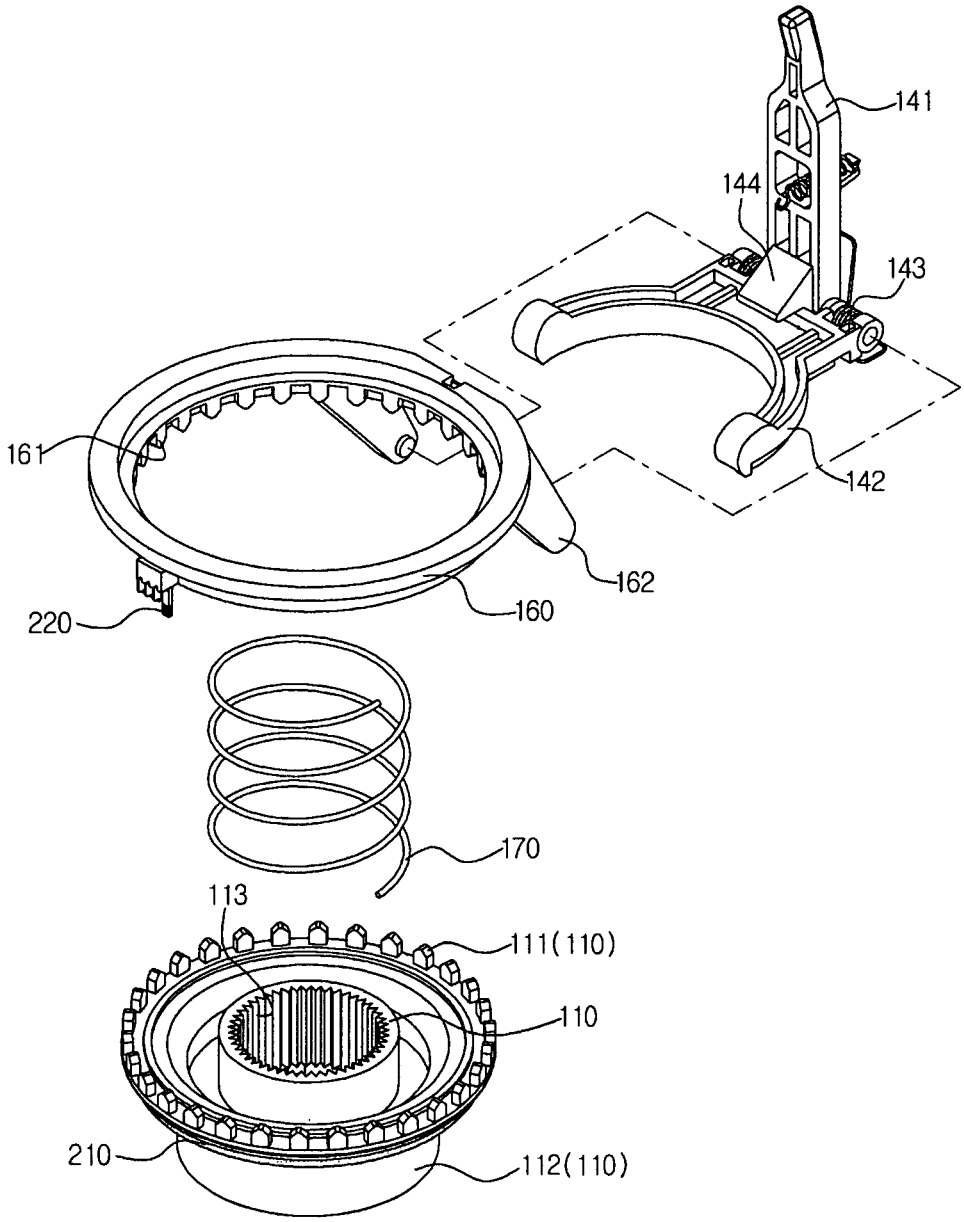
FIG. 5 is an exploded perspective view of the power switching device of the washing machine of FIG. 1.

FIG. 2 illustrates the operation of the power switching device in a washing mode of the washing machine of FIG. 1. FIG. 3 illustrates the operation of the power switching device in a spin-drying mode of the washing machine of FIG. 1. FIG. 4 illustrates the structure of the power switching device of the washing machine of FIG. 1. FIG. 5 is an exploded perspective view of the power switching device of the washing machine of FIG. 1.

The drive motor 51 may be embodied by a brushless direct current (BLDC) motor having a variably controllable rotation speed. As shown in FIGS. 2 to 5, the drive motor includes stator 51*a* and a rotor 51*b* configured to rotate through electromagnetic interaction with the stator 51*a*.

The rotor 51*b* is provided at the rotation center thereof with a hub 52, which is axially coupled to the washing shaft 70. The rotor 51*b* is disposed at the outer circumference of the drive motor 51 to generate a rotating magnetic field toward the inner circumference of the drive motor 51.

An end of the washing shaft 70 is axially coupled to the hub 52. Also, the hub 52 has a power transmission tooth part 53 engaged with a second tooth part 112 of a coupler 110, which will be described later. Rotation force from the rotor 51*b* is transmitted to the coupler 110 through the engagement between the power transmission tooth part 53 and the second tooth part 112.

The power switching device 100 includes a coupler 110 to move upward or downward to transmit the drive force from the drive motor to the washing shaft 70 alone or to both the spin-drying shaft 60 and the washing shaft 70 and an actuator to generate drive force to move the coupler 110 upward and downward. The drive force from the actuator 120 is transmitted to the coupler 110 via a rod 130 and a rotation lever 140. Reference numeral 160 indicates a rotation prevention unit fixed to the bottom of the water tub 20.

The coupler 110 has a first tooth part 111 and the second tooth part 112 provided at the upper and lower parts thereof and a serrated part 113 provided at the inner circumference thereof.

The coupler 110 slides up and down between the rotation prevention unit 160 and the rotor 51*b* of the drive motor 51. At this time, the serrated part 113 formed at the inner circumference of the coupler 110 is engaged with a serrated part 61 formed the outer circumference of the spin-drying shaft 60.

The actuator 120 is an electric motor to generate rotation force. When power is supplied to the actuator 120, a wire 150, one end of which is connected to the rod 130 and the other end of which is connected to the actuator 120, is wound on the actuator 120, with the result that the rod 130 slides toward the actuator 120. Of course, the actuator 120 is not limited to such an electric motor to generate rotation force. The actuator 120 may be embodied by a hydraulic cylinder or a linear motor.

One end of the rod 130 is connected to the actuator 120 via the wire 150, and the other end of the rod 130 is connected to the rotation lever 140. Therefore, the rod 130 is moved forward and backward by the drive force generated from the actuator 120 to rotate the rotation lever 140. Reference numeral 131 indicates a guide case mounted in a lower housing 21 to guide forward and backward movement of the rod 130.

The rotation lever 140 includes a first rotation lever 141 one end of which is connected to the rod 130, a second rotation lever 142 one end of which is rotatably connected to the first rotation lever 141 and the other end of which supports the coupler 110, a torsion spring 143 to buffer rotation force of the first rotation lever 141 in one direction such that the buffered rotation force is transmitted to the second rotation lever 142, and a stopper 144 to limit rotation of the second rotation lever 142 toward the first rotation lever 141 by the torsion spring 143. The rotation lever 140 with the above-stated construction is rotatably mounted at a rotary shaft 162 provided at the rotation prevention unit 160.

A detection unit 200 detects the position of the coupler 110. Specifically, the detection unit 200 detects an upward position where the coupler 110 is moved upward to be normally tooth-engaged with the rotation prevention unit of the water tub or a downward position where the coupler 110 is moved downward to be normally tooth-engaged with the rotor of the drive motor. Therefore, when the coupler 110 is located at the upward position, it is confirmed that the coupler 110 is normally tooth-engaged with the rotation prevention unit of the water tub, and, when the coupler 110 is located at the downward position, it is confirmed that the coupler 110 is normally tooth-engaged with the rotor of the drive motor. At this time, it may be detected that the coupler 110 escapes from the upward position instead of detecting the downward position. This is because, when escaping from the upward position, the coupler 110 is moved downward by force to move the coupler 100 and by weight of the coupler 110 and is normally tooth-engaged with the rotor of the drive motor. In this case, the detection unit 200 outputs a high signal when the coupler 110 reaches the upward position and a low signal when the coupler 110 reaches the downward position.

To this end, the detection unit 200 includes a permanent magnet 210 provided at the coupler 110 and a hole sensor 220 opposite to the outer circumference of the permanent magnet 210. The permanent magnet 210 is formed in a ring shape. The permanent magnet 210 is mounted at the bottom of the first tooth part 111 of the coupler 110. The hole sensor 220 is mounted at the rotation prevention unit fixed at the bottom of the water tub 20 to detect a magnetic field generated by the permanent magnet 210.

When the coupler 110 is moved upward with the result that the first tooth part 111 of the coupler is engaged with a rotation prevention tooth part 161 of the rotation prevention unit 160, the hole-sensor 220 detects the permanent magnet 210 to output a signal. Consequently, it is detected whether the first tooth part 111 of the coupler is normally engaged with the rotation prevention tooth part 161 of the rotation prevention unit 160. Also, when the coupler 110 is moved downward with the result that the first tooth part 111 of the coupler 110 is disengaged from the rotation prevention tooth part 161 of the rotation prevention unit 160, the permanent magnet 210 is not detected by the hole sensor 220. Consequently, it is detected whether the first tooth part 111 of the coupler 110 is normally disengaged from the rotation prevention tooth part 161 of the rotation prevention unit 160. The permanent magnet 210 is formed in the ring shape. Therefore, when the first tooth part 111 of the coupler 110 is normally engaged with the rotation prevention tooth part 161 of the rotation prevention unit 160 irrespective of the rotational position of the coupler 110, the permanent magnet 210 is opposite to the hole sensor 220, and therefore, the hole sensor 220 outputs a signal. On the other hand, when the first tooth part 111 of the coupler 110 is not normally engaged with the rotation prevention tooth part 161 of the rotation prevention unit 160, the permanent magnet 210 is not opposite to the hole sensor 220, and therefore, the hole sensor 220 outputs no signal.

The coupler 110 is moved toward the rotation prevention unit 160 by the rotation lever 140 driven by the actuator 120 and is returned to the drive motor 51 by a coil spring 170 to elastically support the coupling downward.

In the washing mode, the coupler 110 is moved upward, with the result that the teeth of the coupler 110 are engaged with the teeth of the rotation prevention unit 160 of the water tub 20, thereby fixing the spin-drying shaft 60. When the drive motor 51 is rotated in alternating directions, the washing shaft 70 is rotated by the rotation of the drive motor 51, and therefore, the pulsator 40 connected to the washing shaft 70 is rotated. That is, when the coupler 110 is moved upward to come into tight contact with the rotation prevention unit 160 (see FIG. 2), the first tooth part 111 of the coupler 110 is engaged with the rotation prevention tooth part 161 of the rotation prevention unit 160. In this state, drive force from the drive motor 51 is transmitted only to the washing shaft 70 axially coupled to the hub 52 of the rotor 51*b* of the drive motor 51, not to the spin-drying shaft 60. Consequently, the rotation of the spin-drying shaft 60 is prevented by the rotation prevention unit 160, and the washing mode of the washing machine is performed.

In the spin-drying mode, the coupler 110 is moved downward, with the result that the teeth of the coupler 110 are engaged with the teeth of the rotor 51*b* and disengaged from the teeth of the rotation prevention unit 160 of the water tub 20. When the drive motor 51 is rotated to perform spin-drying, the spin-drying 60 is rotated by the rotation of the drive motor 51, and therefore, the spin-drying tub 30 and the pulsator 40 are simultaneously rotated. That is, when the coupler 110 is moved downward to come into tight contact with the rotor 51*b* of the drive motor 51 (see FIG. 3), the second tooth part 112 of the coupler 110 is engaged with the power transmission tooth part 53 provided at the hub 52 of the rotor 51*b*. In this state, drive force from the drive motor 51 is transmitted to both the washing shaft 70 and the spin-drying shaft 60, and the spin-drying mode of the washing machine is performed.

Upon switching from the washing mode to the spin-drying mode or from the spin-drying mode to the washing mode, a signal output from the detection unit 200 to detect the position of the coupler 110 is input to a controller to perform overall control of the washing machine. The controller confirms the position of the coupler 110 based on the signal received from the detection unit 200 to determine whether the coupling between the coupler 110 and the rotation prevention unit 160 or between the coupler 110 and the rotor 51*b* is normal. When the coupling is abnormal, the controller controls the drive motor 51 to be rotated in alternating directions such that the coupler 110 is shaken right and left and the coupling is normal. Alternatively, the controller performs switching to an opposite mode (a mode before switching, i.e., a spin-drying mode for a washing mode and a washing mode for a spin-drying mode) to move the coupler 110 to a position before switching, to release the prior coupling state, and to shake the coupler 110 right and left. Subsequently, the controller performs reswitching to the original mode (mode to be switched) to move the coupler 110 to a position where the mode is to be switched and to perform recoupling. The switching to the opposite mode, the right and left shaking of the coupler 110, and the reswitching to the original mode are performed until the normal coupling of the coupler 110 is achieved. However, when the normal coupling of the coupler 110 is not achieved even after a predetermined number of repetitions, the operation of the washing machine is stopped, and an error message is displayed on a manipulation panel or a buzzer is output to inform a user of a malfunction.

Figure 6:
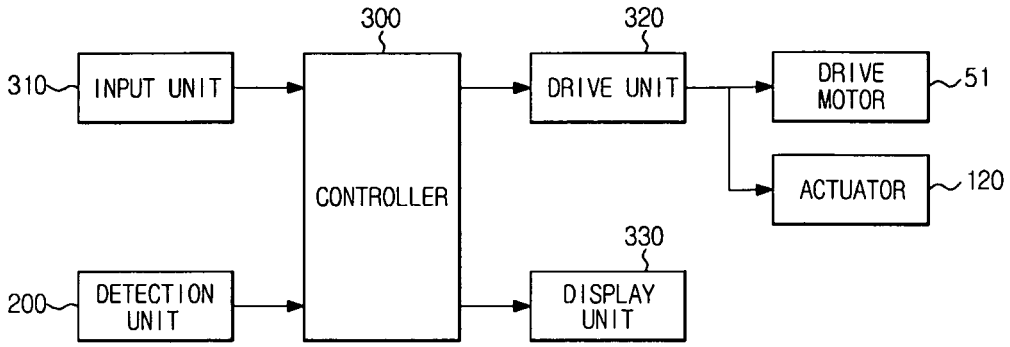
FIG. 6 is a schematic control block diagram of the washing machine of FIG. 1.

FIG. 6 is a schematic control block diagram of the washing machine of FIG. 1.

As shown in FIG. 6, the washing machine includes a controller 300 to perform overall control of the washing machine.

An input unit 310 and the detection unit 200 are electrically connected to an input side of the controller 300. A drive unit 320 and a display unit 330 are electrically connected to an output side of the controller 300.

The input unit 310 allows a user to input a command. Specifically, the input unit 310 allows the user to input a command of switching from the washing mode to the spin-drying mode or a command of switching from the spin-drying mode to the washing mode.

The detection unit 200 detects the position of the coupler 110.

The drive unit 320 drives the drive motor 51 or the actuator 120.

The display unit 330 displays a coupling error between the coupler 110 and the rotation prevention unit 160 of the water tub 20 or a coupling error between the coupler 110 and the rotor 51*b* of the drive motor 51.

A signal detected by the detection unit 200 when switching from the washing mode to the spin-drying mode or from the spin-drying mode to the washing mode is input to the controller 300 to perform overall control of the washing machine. The controller 300 confirms the position of the coupler 110 based on the signal detected by the detection unit 200 to determine whether, when switching from the spin-drying mode to the washing mode, the coupler 110 is moved accurately to the upward position where the coupler 110 is normally engaged with the rotation prevention unit 160 of the water tub 20, thereby achieving normal tooth-engagement between the coupler 110 and the rotation prevention unit 160 of the tub 20 and to determine whether, when switching from the washing mode to the spin-drying mode, the coupler 110 is disengaged from the rotation prevention unit 160 of the tub 20 and is moved accurately downward, thereby achieving normal tooth-engagement between the coupler 110 and the rotor 51*b* of the drive motor 51.

When the tooth-engagement between the coupler 110 and the rotation prevention unit 160 is abnormal upon switching from the spin-drying mode to the washing mode or when the tooth-engagement between the coupler 110 and the rotor 51*b* is abnormal upon switching from the washing mode to the spin-drying mode, the controller 300 controls the drive motor 51 to be temporarily rotated in alternating directions such that the coupler 110 is shaken right and left. As a result, the teeth of the coupler 110 are engaged with the teeth of the rotation prevention unit 160 while the coupler 110 is shaken right and left, thereby achieving normal coupling between the coupler 110 and the rotation prevention unit 160.

Specifically, when the tooth-engagement between the coupler 110 and the rotation prevention unit 160 of the water tub 20 is abnormal upon switching from the spin-drying mode to the washing mode, the controller 300 performs switching from the washing mode to the spin-drying mode to move the coupler 110 downward through the actuator 120. As a result, the coupler 110, abnormally coupled to the rotation prevention unit 160 of the water tub 20, is moved downward to be tooth-engaged with the rotor 51*b* of the drive motor 51. In this state, the controller 300 controls the drive motor 51 to be temporarily rotated in alternating directions such that the coupler 110 is shaken right and left. Subsequently, the controller 300 performs reswitching to the original washing mode to move the coupler 110, shaken right and left, upward such that the coupler 110 is tooth-engaged with the rotation prevention unit 160. This process is repeatedly performed until the normal tooth-engagement between the coupler 110 and the rotation prevention unit 160 is achieved.

Also, when the tooth-engagement between the coupler 110 and the rotor 51*b* of the drive motor 51 is abnormal upon switching from the washing mode to the spin-drying mode, the controller 300 performs switching from the spin-drying mode to the washing mode to move coupler 110 upward through the actuator 120. As a result, the coupler 110, abnormally coupled to the rotor 51*b* of the drive motor 51, is moved upward. In this state, the controller 300 controls the drive motor 51 to be temporarily rotated in alternating directions such that the coupler 110 is shaken right and left. Subsequently, the controller 300 performs reswitching to the original spin-drying mode to move the coupler 110, shaken right and left, downward such that the coupler 110 is tooth-engaged with the rotor 51*b* of the drive motor 51. This process is repeatedly performed until the normal tooth-engagement between the coupler 110 and the rotor 51*b* of the drive motor 51 is achieved. However, when the normal coupling between the coupler 110 and the corresponding member is not achieved even after a predetermined number of repetitions, the controller 300 controls the operation of the washing machine to be stopped and an error message to be displayed on the display unit 330.

Hereinafter, a method of correcting abnormal coupling between the coupler 110 and the rotation prevention unit 160 of the water tub 20 or between the coupler 110 and the rotor 51*b* of the drive motor 51 when switching between modes the washing machine with the above-stated construction will be described.

Figure 7:
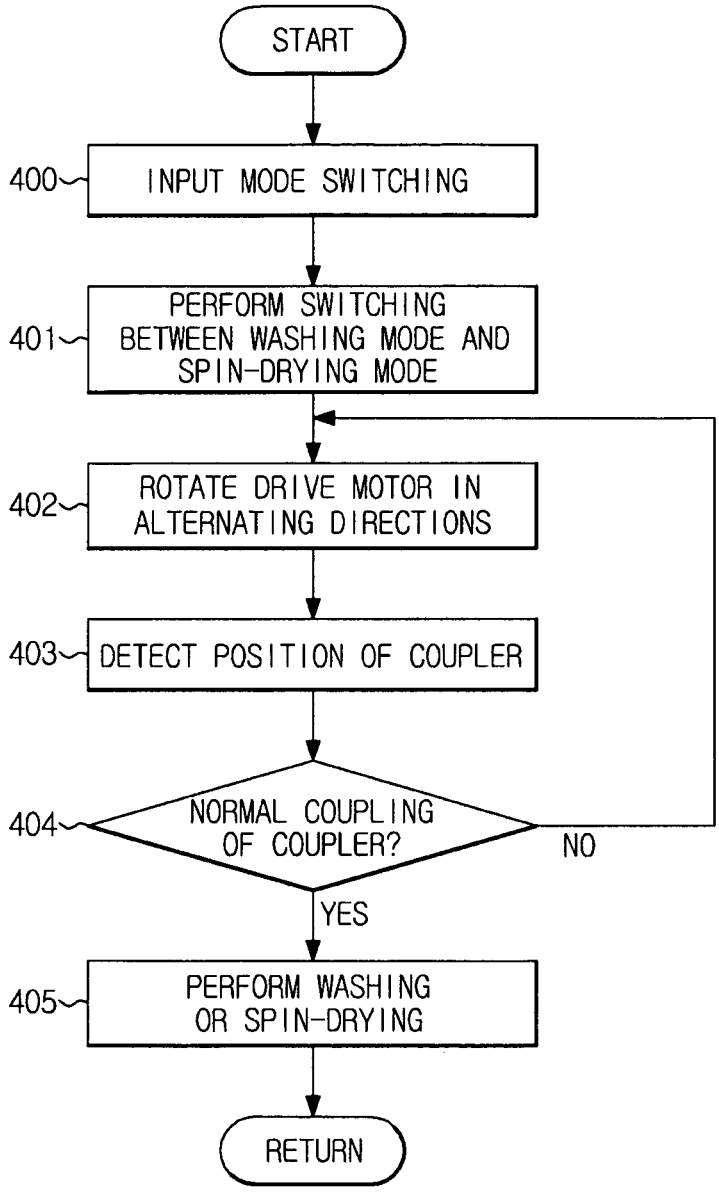
FIG. 7 is a control flow chart illustrating a method of correcting abnormal coupling between a coupler and a rotation prevention unit or between the coupler and a rotor when switching between modes in the washing machine of FIG. 1.

FIG. 7 is a control flow chart illustrating a method of correcting abnormal coupling between the coupler 110 and the rotation prevention unit 160 or between the coupler 110 and the rotor 51*b* when switching between modes in the washing machine of FIG. 1. First, a command of mode switching is input to the controller 300 through the input unit 310 (400).

When the command of mode switching is input, the controller 300 drives the actuator 120 through the drive unit 320 to perform switching from a spin-drying mode to a washing mode or from the washing mode to the spin-drying mode (401). When switching from the spin-drying mode to the washing mode, in a normal state, the coupler 110 is moved upward by the rotation lever 140 driven by the actuator 120 to come into tight contact with the rotation prevention unit 160 of the water tub 20. As a result, the first tooth part 111 of the coupler 110 is normally tooth-engaged with the rotation prevention tooth part 161 of the rotation prevention unit 160. In this state, drive force from the drive motor 51 is transmitted only to the washing shaft 70 axially coupled to the hub 52 of the rotor 51*b* of the drive motor 51, not to the spin-drying shaft 60. Consequently, the rotation of the spin-drying shaft 60 is prevented by the rotation prevention unit 160, thereby performing the washing mode in which only the pulsator 40 is rotated.

On the other hand, when switching from the washing mode to the spin-drying mode, in a normal state, the coupler 110 is moved downward by the rotation lever 140 driven by the actuator 120 to come into tight contact with the rotor 51. As a result, the second tooth part 112 of the coupler 110 is normally tooth-engaged with the power transmission tooth part 53 of the hub 52 of the rotor 51*b*. In this state, drive force from the drive motor 51 is transmitted to both the washing shaft 70 and the spin-drying shaft 60, thereby performing the spin-drying mode in which the pulsator 40 and the spin-drying tub 30 are simultaneously rotated.

After mode switching, the controller 300 controls the drive motor 51 to be temporarily rotated in alternating directions such that the coupling between the coupler 110 and the rotation prevention unit 160 or the coupling between the coupler 110 and to the rotor 51*b* is more securely achieved (402). As a result, the tooth-engagement therebetween is performed while the coupler 110 is shaken right and left, thereby achieving smooth coupling therebetween.

After the rotation of the drive motor 51 in alternating directions, the controller 300 detects the position of the coupler 110 through the detection unit 200 (403).

Subsequently, the controller 300 determines based on the detected position of the coupler 110 whether the coupling of the coupler 110 is normal (404). When the coupler 110 is located at a position where the coupler 110 is normally coupled to the rotation prevention unit 160 of the water tub 20, it is determined that the coupling of the coupler 110 is normal. On the other hand, when the coupler 110 is not located at the position where the coupler 110 is normally coupled to the rotation prevention unit 160 of the water tub 20, it is determined that the coupling of the coupler 110 is abnormal.

When it is determined that the coupling of the coupler 110 is abnormal, the procedure returns to Operation 402, where the controller 300 repeatedly controls the drive motor 51 to be temporarily rotated in alternating directions (402), detects the position of the coupler 110 through the detection unit 200 (403), and determines whether the coupling of the coupler 110 is normal until the coupling of the coupler 110 is normal 9404). However, when the normal coupling of the coupler 110 is not achieved even after a predetermined number of repetitions, the controller 300 controls the operation of the washing machine to be stopped and an error message to be displayed on the manipulation panel or a buzzer to be output to inform a user of malfunction.

On the other hand, when it is determined that the coupling of the coupler 110 is normal, the controller 300 controls a washing cycle or a spin-drying cycle to be performed according to the coupling state of the coupler 110 (405).

Although the coupling of the coupler 110 is abnormal, the coupling of the coupler 110 may be normalized simply by rotating the drive motor 51 in alternating directions when a load of laundry is small.

When a load of laundry is large, however, the coupling of the coupler 110 may not be normalized by rotating the drive motor 51 in alternating directions.

In this case, therefore, switching to an opposite mode is performed to move the coupler 110 in the opposite direction, thereby releasing the coupling of the coupler 110. Subsequently, the drive motor 51 is rotated in alternating directions to shake the coupler 110 right and left, thereby correcting the positions of the tooth parts 111 and 112 of the coupler 110. After that, reswitching to the original mode is performed to move the coupler 111 to a coupling position, thereby achieving the recoupling of the coupler 110. In this way, a probability of coupler coupling success may be increased.

Hereinafter, a method of correcting abnormal coupling between the coupler 110 and the rotation prevention unit 160 of the water tub 20 or abnormal coupling between the coupler 110 and the rotor 51*b* of the drive motor 51 through switching to an opposite mode will be described.

Figure 8:
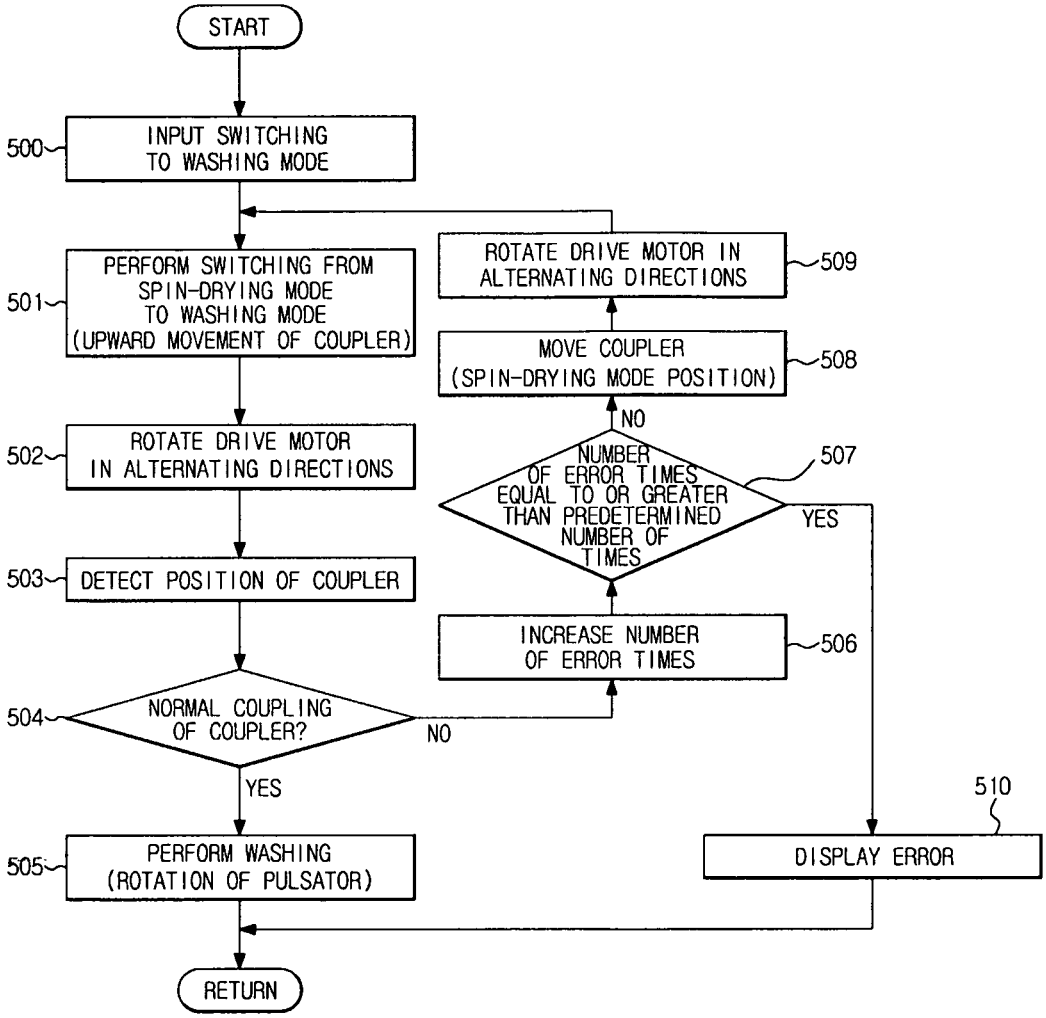
FIG. 8 is a control flow chart illustrating a method of correcting abnormal coupling between a coupler and a rotation prevention unit of a water tub when switching from a spin-drying mode to a washing mode in a washing machine according to another embodiment.

FIG. 8 is a control flow chart illustrating a method of correcting abnormal coupling between a coupler 100 and a rotation prevention unit 160 of a water tub 20 when switching from a spin-drying mode to a washing mode in a washing machine according to another embodiment.

Referring to FIG. 8, a command of switching to the washing mode is input to the controller 300 through the input unit 310 (500).

When the command of switching to the washing mode is input, the controller 300 drives the actuator 120 through the drive unit 320 to perform switching from the spin-drying mode to the washing mode (501). At this time, in a normal state, the coupler 110 is moved upward by the rotation lever 140 driven by the actuator 120 to come into tight contact with the rotation prevention unit 160. As a result, the first tooth part 111 of the coupler 110 is normally tooth-engaged with the rotation prevention tooth part 161 of the rotation prevention unit 160. In this state, drive force from the drive motor 51 is transmitted only to the washing shaft 70 axially coupled to the hub 52 of the rotor 51*b* of the drive motor 51, not to the spin-drying shaft 60. Consequently, only the pulsator 40 is rotated.

After switching to the washing mode, the controller 300 controls the drive motor 51 to be temporarily rotated in alternating directions such that the coupling between the coupler 110 and the rotation prevention unit 160 is more securely achieved (502). As a result, the tooth-engagement therebetween is performed while the coupler 110 is shaken right and left, thereby achieving smooth coupling therebetween.

After the rotation of the drive motor 51 in alternating directions, the controller 300 detects the position of the coupler 110 through the detection unit 200 (503).

Subsequently, the controller 300 determines based on the detected position of the coupler 110 whether the coupling of the coupler 110 is normal (504). When the coupler 110 is located at a position where the coupler 110 is normally coupled to the rotation prevention unit 160 of the water tub 20, it is determined that the coupling of the coupler 110 is normal. On the other hand, when the coupler 110 is not located at the position where the coupler 110 is normally coupled to the rotation prevention unit 160 of the water tub 20, it is determined that the coupling of the coupler 110 is abnormal.

When it is determined at Operation 504 that the coupling of the coupler 110 is normal, the controller 300 controls the pulsator 40 to be rotated to perform washing (505).

On the other hand, when it is determined at Operation 504 that the coupling of the coupler 110 is abnormal, the controller 300 increases the number of error times indicating abnormal coupling of coupler 110 (506), accumulatively stores the number of error times, and determines whether the stored number of error times is equal to or greater than a predetermined number of times (507). When it is determined that the stored number of error times is less than the predetermined number of times, the controller 300 moves the coupler 110 downward through the actuator 120 to decouple the coupler 110, abnormally coupled to the rotation prevention unit 160 of the water tub 20, from the rotation prevention unit 160 of the water tub 20 and to couple the coupler 110 to the rotor 51*b* of the drive motor 51, thereby moving the coupler 110 to a spin-drying mode position (508). For example, the controller 300 performs switching from the washing mode to a temporary spin-drying mode to move the coupler 110 downward such that the coupler 110 is decoupled from the rotation prevention unit 160 and is coupled to the rotor 51*b* of the drive motor 51. At this time, the temporary spin-drying mode may be a mode to perform a command of coupler movement to move the coupler 110 to the spin-drying mode position simply to correct the tooth position of the coupler 110 although the temporary spin-drying mode may be a spin-drying mode including a series of operations to perform a spin-drying cycle. According to the command of coupler movement, the coupler 110 is moved downward by the rotation lever 140 driven by the actuator 120 to come into tight contact with the rotor 51*b* of the drive motor 51. As a result, the second tooth part 112 of the coupler 110 is normally tooth-engaged with the power transmission tooth part 53 of the hub 52 of the rotor 51*b*. In this state, drive force from the drive motor 51 is transmitted to both the washing shaft 70 and the spin-drying shaft 60, and therefore, the pulsator 40 and the spin-drying tub 30 are simultaneously rotated.

Subsequently, the controller 300 controls the drive motor 51 to be rotated in alternating directions such that the coupler 110 is shaken right and left (509). As the drive motor 51 is rotated in alternating directions, the coupler 110, tooth-engaged with the rotor 51*b* of the drive motor 51, is shaken right and left, with the result that the positions of the tooth parts 111 and 112 of the coupler 110 are corrected. At this time, drive force from the drive motor 51 is transmitted to both the washing shaft 70 and the spin-drying shaft 60, and therefore, the pulsator 40 and the spin-drying tub 30 are simultaneously agitated. When viewing the operations of the pulsator 40 and the spin-drying tub 30 from the outside, therefore, a correcting operation to shake the coupler 110 right and left is visually confirmed.

After the rotation of the drive motor 51 in alternating directions, the procedure returns to Operation 501 to recouple the coupler 110 to the rotation prevention unit 160, and the controller 300 performs switching from the temporary spin-drying mode to the washing mode, with the result that the coupler 110 is moved upward to a position where the coupler 110 is coupled to the rotation prevention unit 160. Consequently, the coupler 110, the tooth positions of which have been corrected, is decoupled from the rotor 51*b* of the drive motor 51 and is recoupled to the rotation prevention unit 160. At this time, a probability of success of normal coupling between the coupler 110 and the rotation prevention unit 160 is increased since the tooth positions of the coupler 110 have been corrected.

On the other hand, when it is determined at Operation 507 that the stored number of error times is equal to or greater than the predetermined number of times, which means that the coupling of the coupler is defective in spite of several operations to correct the tooth positions of the coupler 110, the controller 300 controls the operation of the washing machine to be stopped to prevent damage to the coupler 110 and the rotation prevention unit 160 and controls an error message to be displayed on the display unit 330 (510).

Figure 9:
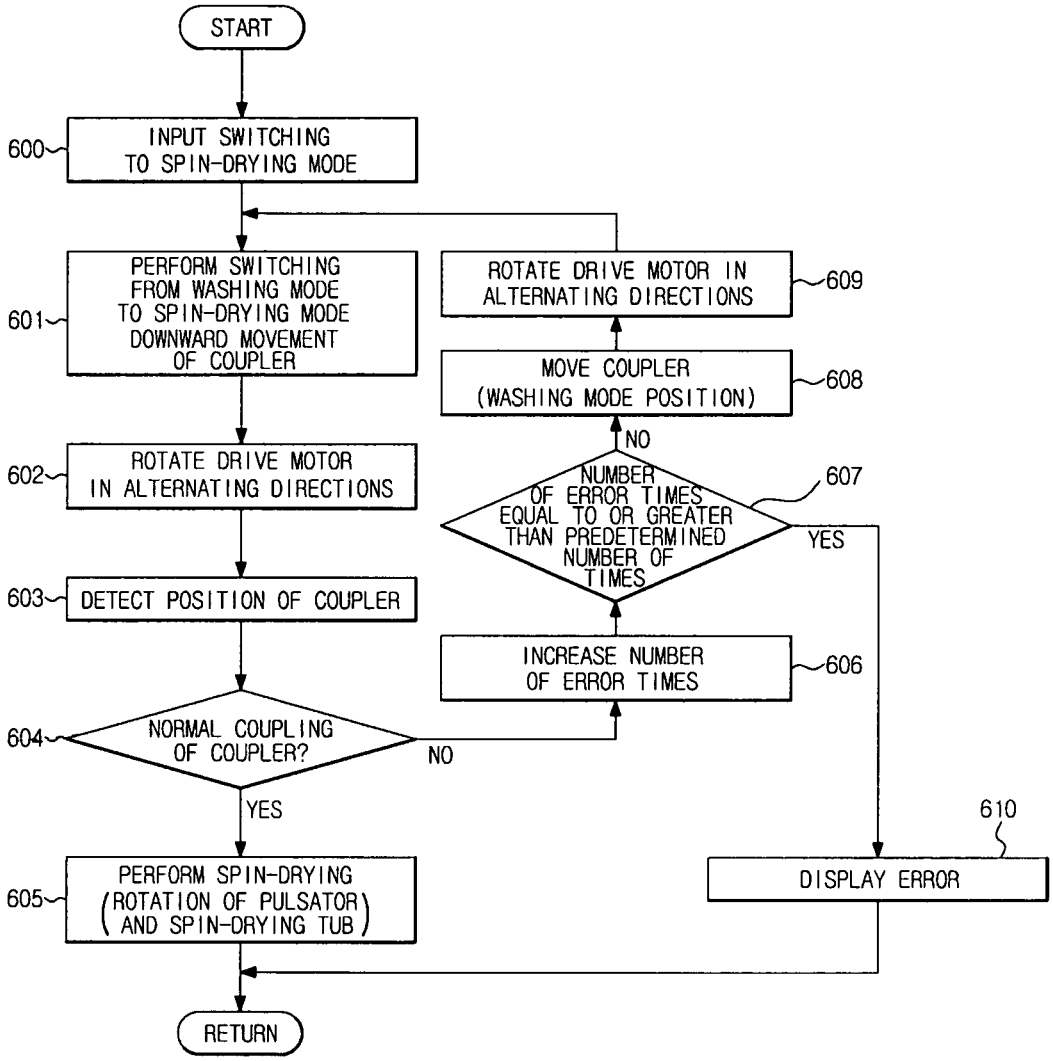
FIG. 9 is a control flow chart illustrating a method of correcting abnormal coupling between the coupler and a rotor of a drive motor when switching from the washing mode to the spin-drying mode in the washing machine of FIG. 8.

FIG. 9 is a control flow chart illustrating a method of correcting abnormal coupling between the coupler 110 and rotor 51*b* of the drive motor 51 when switching from the washing mode to the spin-drying mode in the washing machine of FIG. 8.

Referring to FIG. 9, a command of switching to the spin-drying mode is input to the controller 300 through the input unit 310 (600).

When the command of switching to the spin-drying mode is input, the controller 300 drives the actuator 120 through the drive unit 320 to perform switching from the washing mode to the spin-drying mode (601). At this time, in a normal state, the coupler 110 is moved downward by the rotation lever 140 driven by the actuator 120 to come into tight contact with the rotor 51*b*. As a result, the second tooth part 112 of the coupler 110 is normally tooth-engaged with the power transmission tooth part 53 of the hub 52 of the rotor 51*b*. In this state, drive force from the drive motor 51 is transmitted to both the washing shaft 70 and the spin-drying shaft 60. Consequently, the pulsator 40 and the spin-drying tub 30 are simultaneously rotated.

After switching to the spin-drying mode, the controller 300 controls the drive motor 51 to be temporarily rotated in alternating directions such that the coupling between the coupler 110 and the rotor 51*b* is more securely achieved (602). As a result, the tooth-engagement therebetween is performed while the coupler 110 is shaken right and left, thereby achieving smooth coupling therebetween.

After the rotation of the drive motor 51 in alternating directions, the controller 300 detects the position of the coupler 110 through the detection unit 200 (603).

Subsequently, the controller 300 determines based on the detected position of the coupler 110 whether the coupling of the coupler 110 is normal (604). When the coupler 110 is located at a normal position, it is determined that the coupling of the coupler 110 is normal. On the other hand, when the coupler 110 is not located at the normal position, it is determined that the coupling of the coupler 110 is abnormal.

When it is determined at Operation 604 that the coupling of the coupler 110 is normal, the controller 300 controls the pulsator 40 and the spin-drying tub 30 to be simultaneously rotated to perform spin-drying (605).

On the other hand, when it is determined at Operation 604 that the coupling of the coupler 110 is abnormal, the controller 300 increases the number of error times indicating abnormal coupling of coupler 110 (606), accumulatively stores the number of error times, and determines whether the stored number of error times is equal to or greater than a predetermined number of times (607). When it is determined that the stored number of error times is less than the predetermined number of times, the controller 300 moves the coupler 110 upward through the actuator 120 to decouple the coupler 110, abnormally coupled to the rotor 51*b* of the drive motor 51, from the rotor 51*b* of the drive motor 51 and to couple the coupler 110 to the rotation prevention unit 160 of the water tub 20, thereby moving the coupler 110 to a washing mode position (608). For example, the controller 300 performs switching from the spin-drying mode to a temporary washing mode to move the coupler 110 upward such that the coupler 110 is decoupled from the rotor 51*b* of the drive motor 51 and is coupled to the rotation prevention unit 160. At this time, the temporary washing mode may be a mode to perform a command of coupler movement to move the coupler 110 to the washing mode position simply to correct the tooth position of the coupler 110 although the temporary washing mode may be a washing mode including a series of operations to perform a washing cycle. According to the command of coupler movement, the coupler 110 is moved upward by the rotation lever 140 driven by the actuator 120 to come into tight contact with the rotation prevention unit 160. As a result, the first tooth part 111 of the coupler 110 is normally tooth-engaged with the rotation prevention tooth part 161 of the rotation prevention unit 160. In this state, drive force from the drive motor 51 is transmitted only to the washing shaft 70, and therefore, only the pulsator 40 is rotated.

Subsequently, the controller 300 controls the drive motor 51 to be rotated in alternating directions such that the coupler 110 is shaken right and left (609). As the drive motor 51 is rotated in alternating directions, the coupler 110 is shaken right and left, with the result that the positions of the tooth parts 111 and 112 of the coupler 110 are corrected. At this time, drive force from the drive motor 51 is transmitted to the washing shaft 70, and therefore, the pulsator 40 is agitated. When viewing the operations of the pulsator 40 from the outside, therefore, a correcting operation to shake the coupler 110 right and left is visually confirmed.

After the rotation of the drive motor 51 in alternating directions, the procedure returns to Operation 601 to recouple the coupler 110 to the rotor 51*b* of the drive motor 51, and the controller 300 performs switching from the temporary washing mode to the spin-drying mode, with the result that the coupler 110 is moved downward to a position where the coupler 110 is coupled to the rotor 51*b* of the drive motor 51. Consequently, the coupler 110, the tooth positions of which have been corrected, is decoupled from the rotation prevention unit 160 and is recoupled to the rotor 51*b* of the drive motor 51. At this time, a probability of success of normal coupling between the coupler 110 and the rotor 51*b* of the drive motor 51 is increased since the tooth positions of the coupler 110 have been corrected.

On the other hand, when it is determined at Operation 607 that the stored number of error times is equal to or greater than the predetermined number of times, which means that the coupling of the coupler is defective in spite of several operations to correct the tooth positions of the coupler 110, the controller 300 controls the operation of the washing machine to be stopped to prevent damage to the coupler 110 and the rotor 51*b* of the drive motor 51 and controls an error message to be displayed on the display unit 330 (610).

Figure 11:
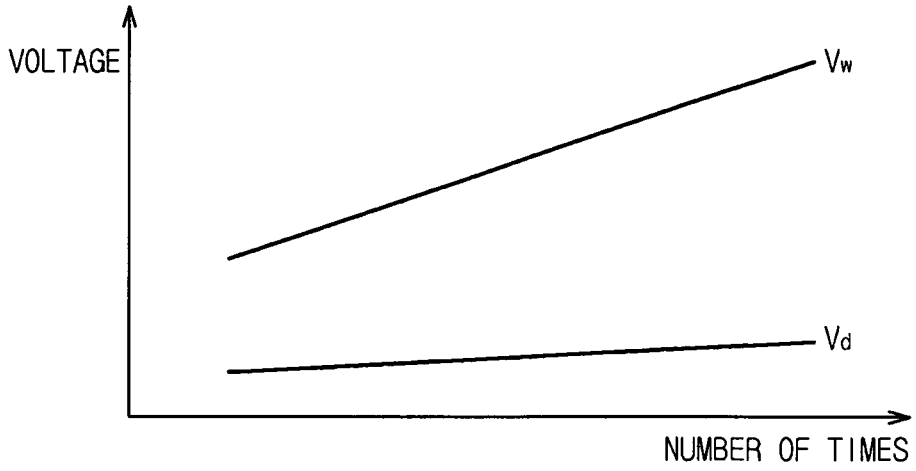
FIG. 11 is a graph illustrating a drive voltage of the drive motor for each mode of FIG. 10.

As shown in FIGS. 10 and 11, when the drive motor 51 is rotated in alternating directions to correct the tooth positions of the coupler, drive voltage applied to the drive motor may be uniform such that rotation force from the drive motor 51 is fixed although the accumulated number of error times indicating abnormal coupling of the coupler 110 is increased. Alternatively, drive voltage applied to the drive motor 51 may be increased with the increase in number of error times to change rotation force from the drive motor. For example, the drive voltage applied to the drive motor 51 when the drive motor 51 is rotated in alternating directions in the temporary spin-drying mode may be lower than the drive voltage applied to the drive motor 51 when the drive motor 51 is rotated in alternating directions in the temporary washing mode. This is because, when the drive motor 51 is rotated in alternating directions in the temporary spin-drying mode, the coupler 110 is rapidly shaken right and left, thereby easily correcting the tooth positions of the coupler although the rotation force from the drive motor 51 is not increased since the coupler 110 is coupled to the rotor 51*b* of the drive motor 51; however, when the drive motor 51 is rotated in alternating directions in the temporary washing mode, the rotation force from the drive motor 51 is relatively increased since the coupler 110 is decoupled from the rotor 51*b* of the drive motor 51 such that the coupler 110 is shaken right and left, thereby correcting the tooth positions of the coupler. Also, in the temporary spin-drying mode, the pulsator and the spin-drying tub are simultaneously rotated when the drive motor 51 is rotated in alternating directions, unlike the temporary washing mode. When the drive force from the drive motor 51 is increased, therefore, the spin-drying tub may be visibly twisted, which does not provide an aesthetically pleasing appearance.

Meanwhile, in the above embodiment, when the coupling of the coupler is abnormal, the drive motor 51 is rotated in alternating directions such that the coupler 110 is shaken right and left, thereby achieving normal coupling, or switching to the opposite mode is performed to move the coupler 110, and then the drive motor 51 is rotated in alternating directions such that the coupler 110 is shaken right and left, thereby achieving normal coupling. However, the above two methods may be simultaneously used. That is, when the coupling of the coupler is abnormal, the drive motor 51 may be rotated in alternating directions such that the coupler 110 is shaken right and left, and, when normal coupling is not achieved although the drive motor 51 is rotated in alternating directions, switching to the opposite mode may be performed to move the coupler 110 to the opposite mode position, the drive motor 51 may be rotated in alternating directions such that the coupler 110 is shaken right and left, and switching to the original mode may be performed to achieve normal coupling.

As is apparent from the above description, the position of the coupler moved and tooth-engaged with the rotation prevention unit of the water tub or the rotor of the drive motor when switching from the washing mode to the spin-drying mode or when switching from the spin-drying mode to the washing mode is detected, and it is determined based on the position of the coupler whether the coupling of the coupler is abnormal. When it is determined that the coupling of the coupler is abnormal, switching to the opposite mode is performed to move the coupler and shake the coupler right and left, switching to the original mode is performed to recouple the coupler. Consequently, collision between the teeth is prevented, with the result that damage to the components is reduced, and frictional noise between the teeth is reduced, thereby improving washing performance.

Although a few embodiments have been shown and described, it would be appreciated by those skilled in the art that changes may be made in these embodiments without departing from the principles and spirit of the embodiments, the scope of which is defined in the claims and their equivalents.

What is claimed is:

1. A control method of a washing machine, having a coupler coupled to a rotor of a drive motor when the coupler is in a downward position or coupled to a rotation prevention unit of a water tub when the coupler is in an upward position to selectively transmit power from the drive motor to a washing shaft or a spin-drying shaft, to perform a first mode in which the coupler is moved to the downward position to transmit the power to the washing shaft and the spin-drying shaft and a second mode in which the coupler is moved to the upward position to transmit the power to the washing shaft but not the spin-drying shaft, wherein the control method comprises:

switching from the first mode to the second mode by moving the coupler upward, detecting that the coupler is abnormally coupled to the rotation prevention unit, moving the coupler downward so as to be coupled to the rotor, which corresponds with the first mode, rotating the drive motor to shake the coupler, and then moving the shaken coupler upward so as to be coupled to the rotation prevention unit, to thereby normally couple the rotation prevention unit to the coupler, which corresponds with the second mode; and switching from the second mode to the first mode by moving the coupler downward, detecting that the coupler is abnormally coupled to the rotor, moving the coupler upward so as to be coupled to the rotation prevention unit, which corresponds with the second mode, rotating the drive motor to shake the coupler, and then moving the shaken coupler downward so as to be coupled to the rotor, to thereby normally couple the rotor to the coupler, which corresponds with the first mode.

2. The control method according to claim 1, further comprising:

wherein the determining whether the coupling of the coupler is abnormal comprises:

determining that the coupling of the coupler is abnormal when the position of the coupler is not located at a position where the coupler is normally coupled to the rotor upon switching from the second mode to the first mode; and determining that the coupling of the coupler is abnormal when the position of the coupler is not located at the position where the coupler is normally coupled to the rotation prevention unit upon switching from the first mode to the second mode.

3. The control method according to claim 2, wherein rotating the drive motor to shake the coupler comprises: rotating the drive motor in alternating directions when the coupling of the coupler is abnormal.

4. The control method according to claim 3, further comprising:

redetecting the position of the coupler after the rotating of the drive motor in alternating directions, redetermining based on the redetected position of the coupler, whether the coupling of the coupler is abnormal, moving the coupler to a position before mode switching if determined that the coupling of the coupler is abnormal, rotating the drive motor in alternating directions such that the coupler is shaken, and moving the coupler to a position where the mode switching is to be performed.

5. The control method according to claim 4, further comprising accumulatively storing a number of times of that the coupling is determined to be abnormal upon redetermining that the coupling of the coupler is abnormal and changing a drive voltage to be applied to the drive motor based on the stored number of times when rotating the drive motor moved to the position before the mode switching in alternating directions.

6. The control method according to claim 5, further comprising increasing the drive voltage to be applied to the drive motor when the stored number of times is increased.

7. The control method according to claim 5, further comprising changing the drive voltage to be applied to the drive motor such that the drive voltage to be applied to the drive motor when the position before the mode switching is a position of the first mode is lower than the drive voltage to be applied to the drive motor when the position before the mode switching is a position of the second mode.

8. The control method according to claim 2, further comprising accumulatively storing a number of times that the coupling is determined to be abnormal upon determining that the coupling of the coupler is abnormal and increasing a drive voltage to be applied to the drive motor when the stored number of times is increased.

* * * * *